US008005376B2

(12) United States Patent
Jeon

(10) Patent No.: US 8,005,376 B2
(45) Date of Patent: Aug. 23, 2011

(54) IMAGE FORMING APPARATUS, CARTRIDGE AND IMAGE FORMING METHOD

(75) Inventor: Cheol-min Jeon, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 560 days.

(21) Appl. No.: 12/098,493

(22) Filed: Apr. 7, 2008

(65) Prior Publication Data

US 2009/0041480 A1 Feb. 12, 2009

(30) Foreign Application Priority Data

Aug. 10, 2007 (KR) ..... 10-2007-0080826

(51) Int. Cl.
*G03G 15/00* (2006.01)

(52) U.S. Cl. ..... 399/12

(58) Field of Classification Search ..... 399/12
See application file for complete search history.

(56) References Cited

U.S. PATENT DOCUMENTS 5,021,828 A 6/1991 Yamaguchi et al.
5,995,774 A * 11/1999 Applegate et al. ..... 399/27
6,912,364 B2 * 6/2005 Kim ..... 399/12
2002/0164169 A1 11/2002 Arai et al.
2003/0118355 A1 6/2003 Guy et al.
2003/0228163 A1 * 12/2003 Yokoi et al. ..... 399/27
2005/0254831 A1 * 11/2005 Soga et al. ..... 399/12
2005/0264622 A1 12/2005 Silverbrook et al.
2006/0114491 A1 * 6/2006 Kim et al. ..... 358/1.14

FOREIGN PATENT DOCUMENTS

EP 0720916 A 7/1996
EP 1445109 A 8/2004
EP 1745933 A 1/2007
JP 10239979 A * 9/1998

OTHER PUBLICATIONS

European Search Report issued Nov. 25, 2008 in Europe Application No. 08103238.5.

* cited by examiner

*Primary Examiner* — David M Gray
*Assistant Examiner* — G. M. Hyder
(74) *Attorney, Agent, or Firm* — Stanzione & Kim, LLP

(57) ABSTRACT

An image forming apparatus includes an image forming unit to receive an image forming agent from a cartridge having a state indicating element to form an image, a state setting unit to open the state indicating element, and a controller to determine a usage amount of the image forming agent used to form the image by recognizing identification information of the cartridge, and to control the state setting unit to open the state indicating element of the cartridge if the usage amount of the image forming agent is equal to or greater than a preset value.

20 Claims, 5 Drawing Sheets

IMAGE FORMING APPARATUS, CARTRIDGE AND IMAGE FORMING METHOD

CROSS-REFERENCE TO RELATED APPLICATIONS

This application claims priority from Korean Patent Application No. 10-2007-0080826, filed on Aug. 10, 2007, in the Korean Intellectual Property Office, the disclosure of which is incorporated herein by reference in its entirety.

BACKGROUND OF THE INVENTION

1. Field of the Invention

Apparatuses and methods consistent with the present general inventive concept relate to an image forming apparatus, a cartridge and an image forming method, and more particularly, to an image forming apparatus which sets a state of a cartridge depending on a usage amount of the cartridge, a cartridge and an image forming method.

2. Description of the Related Art

An image forming apparatus forms an image on a recording medium based on printing data. The image forming apparatus includes a cartridge to accommodate an image forming agent therein to be used to form an image. As a consumable, the cartridge should be replaced by a new one after being used up.

A user may replace the cartridge with a cheap and non-genuine cartridge. However, the non-genuine cartridge has properties different from those of the genuine cartridge. Durability of a photosensitive body and a developing unit of an image forming unit of the image forming apparatus is designed corresponding to the amount of initially-stored ink or developer. If the non-genuine cartridge is repetitively used, the photosensitive body and the developing unit become worn. Also, the photosensitive body is not properly cleaned or charged. Further, the ink or the developer may leak or an image may be deteriorated.

However, if the image is deteriorated, a user takes it as a problem of the image forming apparatus itself, and does not recognize that the non-genuine cartridge causes the problem.

SUMMARY OF THE INVENTION

The present general inventive concept provides an image forming apparatus which encourages a user to use a genuine cartridge, and prevents an image from being deteriorated and the apparatus itself from being worn due to a non-genuine cartridge, a cartridge and an image forming method.

The present general inventive concept also provides an image forming apparatus which informs a user whether to reuse a cartridge and improves reliability of a product, a cartridge and an image forming method.

Additional aspects and utilities of the present general inventive concept will be set forth in part in the description which follows and, in part, will be obvious from the description, or may be learned by practice of the present general inventive concept.

The foregoing and/or other aspects of the present general inventive concept are achieved by providing an image forming apparatus, including an image forming unit to form an image and to receive an image forming agent from a cartridge having a state indicating element and forms an image, a state setting unit to open the state indicating element, and a controller to determine a usage amount of the image forming agent to be used to form the image by recognizing identification information of the cartridge, and to control the state setting unit to open the state indicating element of the cartridge if the determined usage amount of the image forming agent is substantially to or greater than a preset value.

The controller may control the image forming unit to not form the image and/or to have a limited image forming function if the identification information of the cartridge is not recognized by the controller.

The limited image forming function may include at least one of a double side printing function, a high resolution function, a predetermined graphic mode, a predetermined printing concentration and a copying function.

The controller may determine the usage amount of the image forming agent by counting dots needed to form the image.

The image forming apparatus may further include an informing unit, wherein the controller provides information regarding the state of the state indicating element through the image forming unit.

The controller may control the state setting unit to apply a predetermined electric current to open the state indicating element.

The state indicating element may include a resistor which is fusible to receive the predetermined electric current.

The foregoing and/or other aspects of the present general inventive concept are also achieved by providing a cartridge, including an accommodator to store an image forming agent therein to be supplied to an image forming apparatus to form an image, and a state indicating element to be opened by the image forming apparatus if a usage amount of the image forming agent required to form an image which is determined by identification information of the cartridge is substantially equal to or greater than a preset value.

The state indicating element may include a fusible resistor.

The foregoing and/or other aspects of the present general inventive concept are also achieved by providing an image forming method, including recognizing identification information of a cartridge and determining a usage amount of an image forming agent required to form an image, determining whether the usage amount of the image forming agent is substantially equal to or greater than a preset value, and opening a state indicating element included in the cartridge if the usage amount is substantially equal to or greater than the preset value.

The determining the usage amount of the image forming agent may further include not performing an image forming operation and/or limiting a predetermined image forming function if the identification information of the cartridge is not recognized.

The limited image forming function may include at least one of a double side printing function, a high resolution function, a predetermined graphic mode, a predetermined printing concentration and a copying function.

The determining the usage amount of the image forming agent may include determining the usage amount of the image forming agent by counting dots needed to form the image.

The opening of the state indicating element may further include providing information regarding the opening state of the state indicating element.

The opening of the state indicating element may include applying a predetermined electric current to the state indicating element.

The state indicating element may include a fusible resistor.

The foregoing and/or other aspects of the present general inventive concept are also achieved by providing an image forming apparatus, including a replaceable printing cartridge having identification information and a selectable disable element, and a controller to form an image if the selectable disable element is not disabled and an amount of image forming agent stored within the cartridge is determined to be sufficient to form the image such that the sufficiency of the amount of the image forming agent is based on the identification information of the cartridge.

The controller may send an electrical signal to the selectable disable element to disable the cartridge if the controller determines that there is insufficient image forming agent to form an image.

The controller may send an electrical signal to the selectable disable element to disable the cartridge if the controller determines that the identification information is not that of a genuine replaceable printing cartridge.

The foregoing and/or other aspects of the present general inventive concept are also achieved by providing a method to control an image forming apparatus, including forming an image based on identification information of a replacement printer cartridge such that a remaining image forming agent amount is compared to a reference value based on the identification information and on whether the identification information is that of a genuine replacement printer cartridge.

The foregoing and/or other aspects of the present general inventive concept are also achieved by providing a computer readable recording medium having encoded thereon computer instructions that when executed by a computer perform a method to control an image forming apparatus, comprising recognizing identification information of a cartridge and determining a usage amount of an image forming agent required to form an image, determining whether the usage amount of the image forming agent is substantially equal to or greater than a preset value, and opening a state indicating element included in the cartridge if the usage amount is substantially equal to or greater than the preset value.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
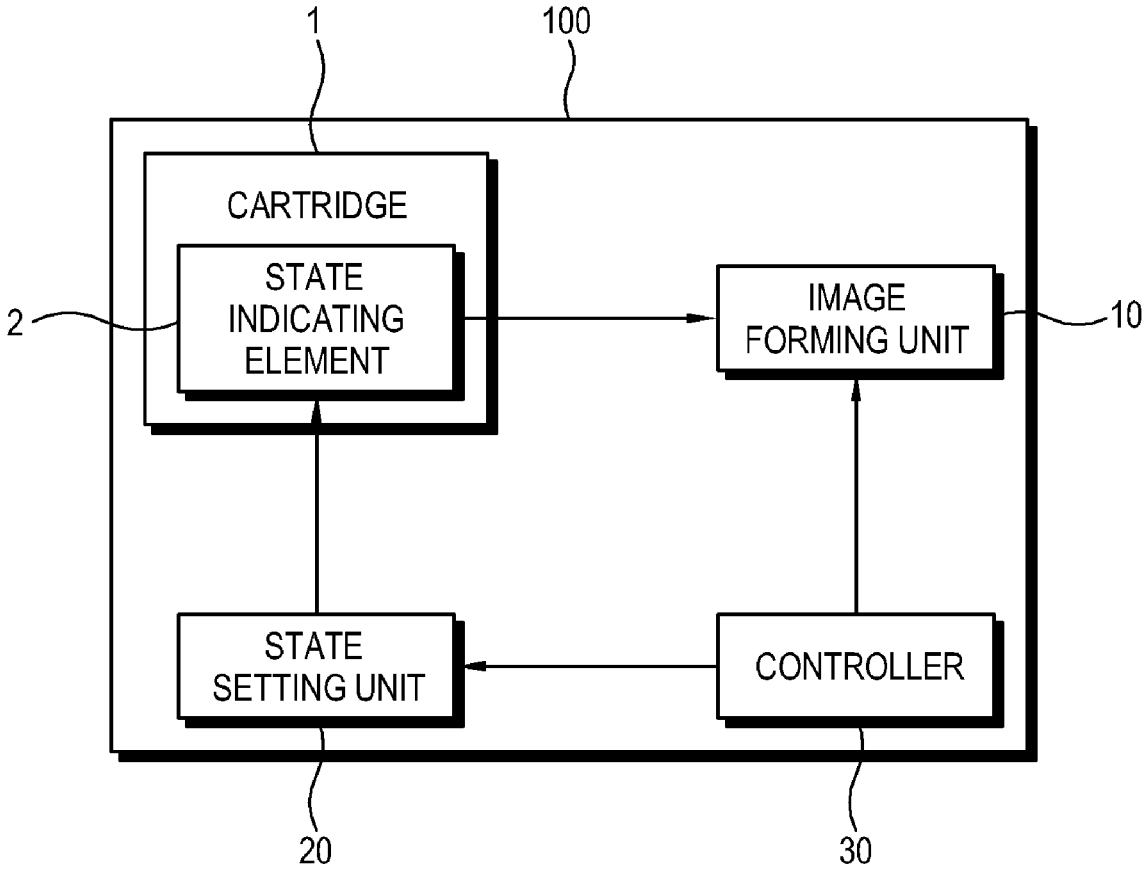
FIG. 1 is a block diagram of an image forming apparatus according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

As illustrated in FIG. 1, an image forming apparatus 100 according to an exemplary embodiment of the present general inventive concept includes an image forming unit 10, a state setting unit 20 and a controller 30. The image forming apparatus 100 according to the present general inventive concept may be an inkjet printer, an electrophotographic printer, a photocopier, a facsimile device, or a multifunctional peripheral (MFP) device which receives printing data and prints stored printing data.

The image forming unit 10 forms an image on a recording medium, for example, printing paper, based on printing data. The image forming unit 10 receives an image forming agent, for example, printer toner or liquid ink, from a cartridge 1, including an accommodator (not illustrated) to accommodate by storing an image forming agent therein, and a state indicating element 2, to form an image.

The image forming unit 10 according to the present general inventive concept may include a photosensitive body (not illustrated) to form an electrostatic latent image thereon, a developing unit (not illustrated) to develop a developer on the photosensitive body, and a transfer unit (not illustrated) to transfer the developer developed on the photosensitive body to a printing medium to form an image thereon. The image forming unit 10 according to the present general inventive concept may also include a discharging unit (not illustrated) to discharge liquid ink to the printing medium according to the printing data.

The state setting unit 20 opens the state indicating element 2 included in the cartridge 1, according to control by the controller 30 (to be described in more detail below). Preferably, the state indicating element 2 of the cartridge 1 includes a fusible resistor which has a low resistance value and is opened by electric current applied by the state setting unit 20.

Figure 2:
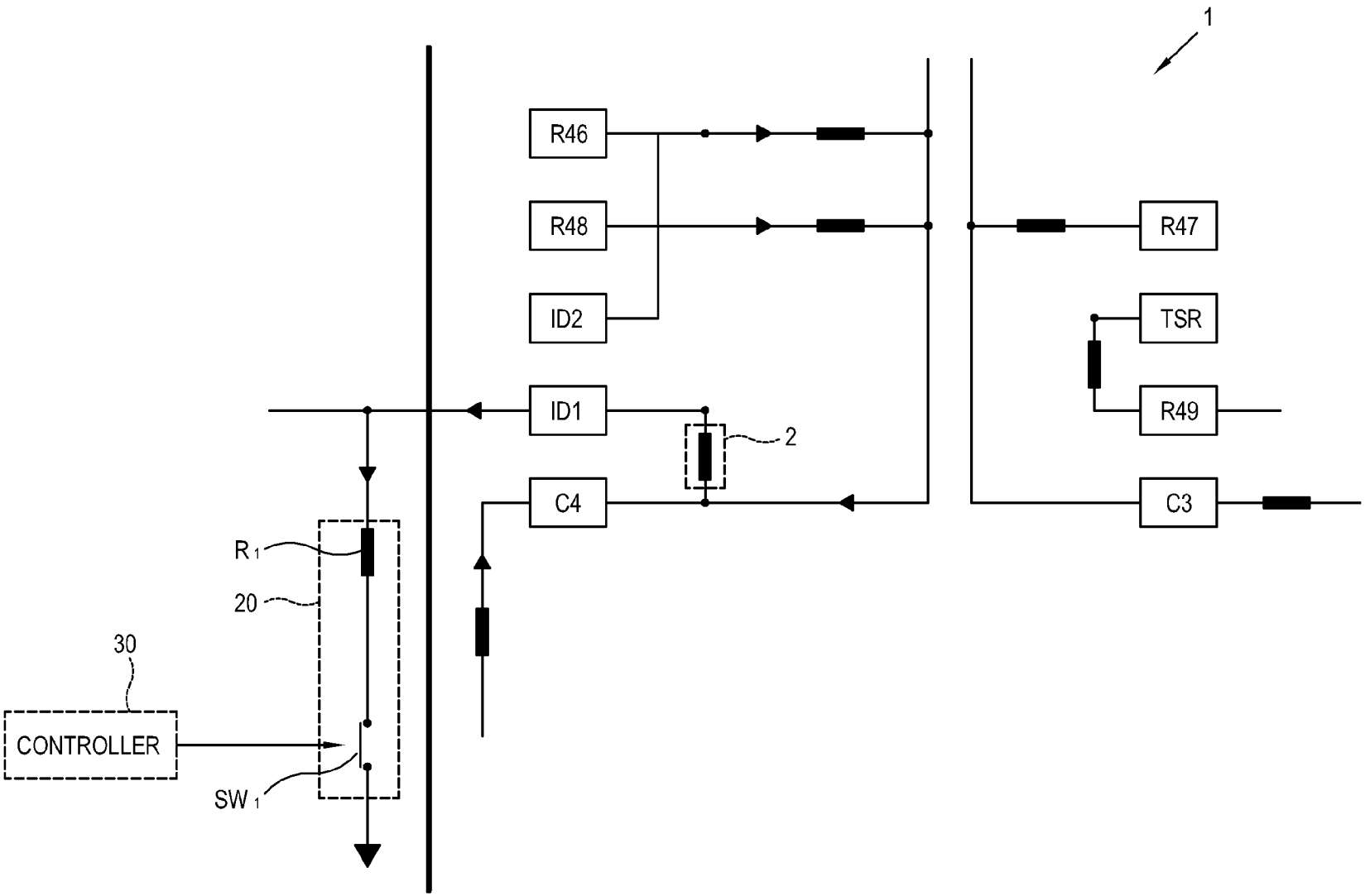
FIG. 2 is a detailed circuit diagram to describe operations of a state setting unit and a controller according to the present general inventive concept.

Referring to FIG. 2, the state setting unit 20 may include a switch SW1 and a resistor R1. The switch SW1 may include a transistor and an FET (field effect transistor) (not illustrated) to apply an electric current to a circuit of the cartridge 1, or a PWM (pulse width modulation) transistor. The state setting unit 20 according to the present general inventive concept will be described later in more detail with reference to FIG. 2.

The controller 30 determines the usage amount of the image forming agent required to form an image, and controls the state setting unit 20 to open the state indicating element 2 if the usage amount of the image forming agent is equal to a preset value or greater than the preset value. The controller 30 determines the usage amount of the image forming agent by counting dots that form the image. Thus, the controller 30 may determine the usage amount of the image forming agent more accurately according to the foregoing method, rather than by counting pages which have been printed using the cartridge 1 or measuring a remaining weight of the image forming agent.

For example, the preset value may be ⅛ of the total amount of the image forming agent originally included in the cartridge 1. When the usage amount of the image forming agent reaches the ⅛ level, i.e. when the residual amount of the image forming agent decreases by ⅞ of the total original amount, the controller 30 turns on the switch SW1 of the state setting unit 20 to apply electric current to and to open the state indicating element 2. Alternatively, the preset value may be inputted by a user.

Hereinafter, an operation of the controller 30 according to the present general inventive concept will be described in detail with reference to FIG. 2.

The controller 30 recognizes identification information of the cartridge 1 to determine the usage amount of the image forming agent. If identification information ID1 stored in the cartridge 1 is not equivalent to identification information ID2 stored in the image forming apparatus 100, the controller 30 may not recognize the cartridge 1 and may control the image forming unit 10 to not form an image, or the controller 30 may control the cartridge 1 to limit some image forming functions thereof to conserve use of the image forming agent remaining in the cartridge 1. For example, the use of a double side printing function may be limited, such that the use of a high resolution (e.g. 1200 dpi or 2400 dpi) function higher than a reference resolution (e.g. 600 dpi) may be limited, and/or the use of particular graphic modes such as a text mode, a gray mode or a solid mode may be limited, and/or a particular printing concentration or a copying function may be limited.

If the image forming apparatus 100 according to the present general inventive concept is a facsimile device or an MFP device, it may store received fax data in a storage unit (not illustrated) and output the stored fax data only if the cartridge 1 is replaced by a new one and identification information thereof is recognizable by the controller 30.

If the respective ID1 and the ID2 identification information are equivalent to each other, the controller 30 determines that the cartridge 1 is a genuine cartridge. Then, the controller 30 controls the image forming unit 10 to form an image based on the printing data. As described above, the controller 30 determines the usage amount of the image forming agent used to form the image. If it is determined that the usage amount of the image forming agent is equal to the preset value or is greater than the preset value, the controller 30 turns on the SW1 of the state setting unit 20 to apply a predetermined electric current to the resistor R1 connected to the state indicating element 2 to open the state indicating element 2 to prevent the cartridge 1 from being usable. In one embodiment, the state indicating element 2 is disposed in series between the ID1 identification information and a capacitive element C4 and has a low resistance value, such as approximately 37 ohms. The controller 30 may detect the opened state indicating element 2 and determine whether to reuse the cartridge 1.

Figure 3:
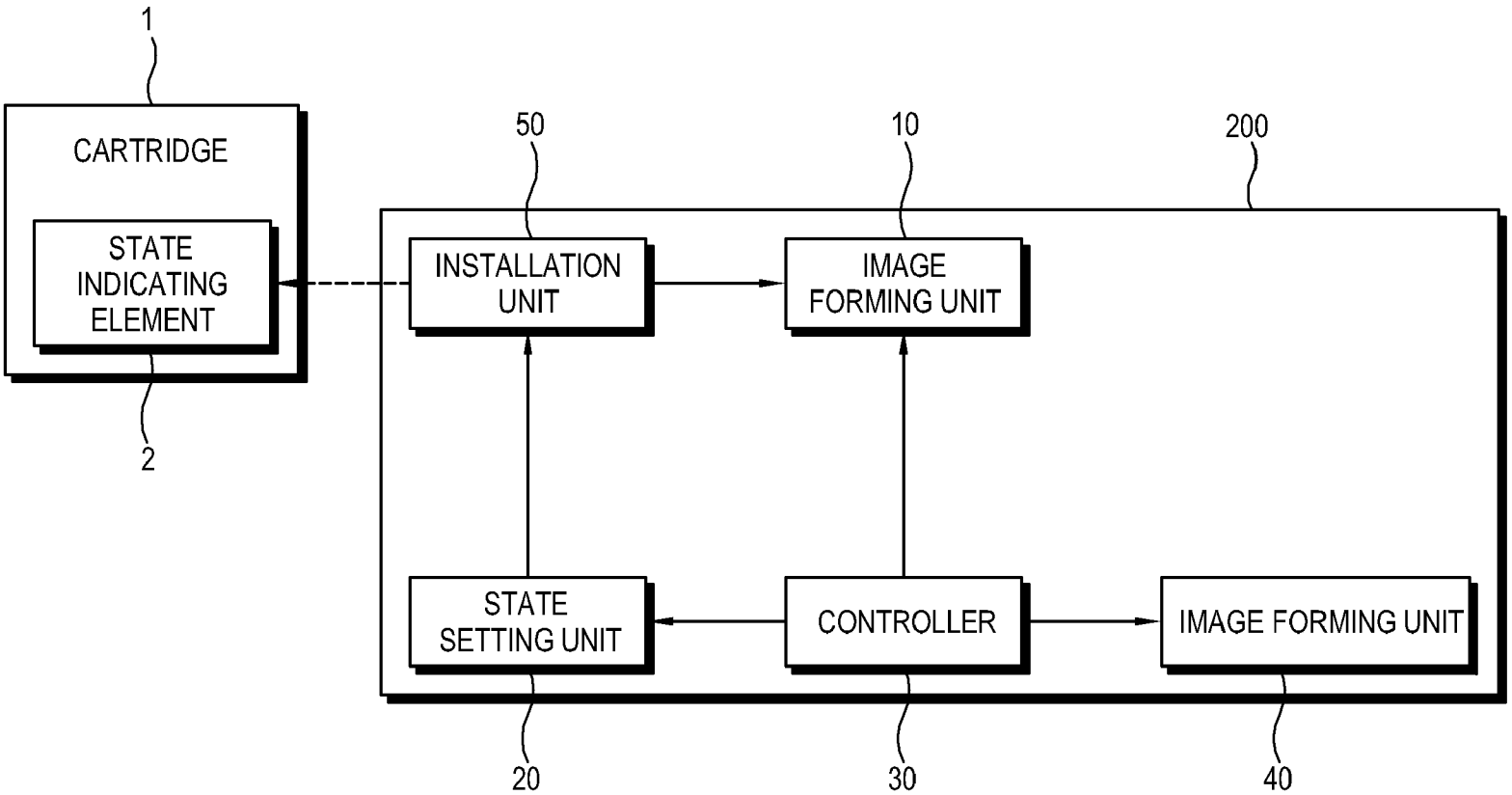
FIG. 3 is a block diagram of an image forming apparatus according to another exemplary embodiment of the present general inventive concept.

Referring to FIG. 3, an image forming apparatus 200 according to another exemplary embodiment of the present general inventive concept may include an informing unit 40, and an installation unit 50 to install a cartridge 1 therein.

The informing unit 40 may generate a status or error message, or a status or error indication, on a display (not illustrated) to inform a user that the state indicating element 2 is open and/or that the cartridge 1 has insufficient or non-authorized image forming agent and must be replaced, under control of the controller 30. That is, the informing unit 40 may inform the controller 30 that the state indicating element 2 is open if the usage amount of the image forming agent is equal to a preset value or greater than the preset value or may inform the controller 30 that the image forming operation is not performed as the identification information of the cartridge 1 is not recognized.

The image forming unit 40 may include a display unit (not illustrated) such as a liquid crystal display (LCD) panel, but is not limited thereto. Alternatively, the image forming unit 40 may include a visual or audible alarm to inform a user that the state indicating element 2 is open and/or that the cartridge 1 has insufficient or non-genuine image forming agent and must be replaced, and/or may send a signal to a server or a computer (not illustrated) connected to the image forming apparatus 100 of same. If the image forming unit 40 according to the present general inventive concept includes a display unit, the informing unit 40 may inform the state of the state indicating element 2 to a user by way of a user interface (UI) or a text message.

More specifically, the image forming unit 40 may generate a UI to indicate, for example "New," to inform a user that the cartridge 1 is new and genuine to supply ink normally if the state indicating element 2 is not set in a supply-limited state. Meanwhile, the informing unit 40 may generate a UI to indicate, for example "Old," to inform a user that the cartridge 1 is reused if the state indicating element 2 is opened and set in a supply-limited state. Thus, a user may easily recognize whether the cartridge 1 is genuine, and the usage state of the cartridge 1.

The installation unit 50 may include an interface to recognize the identification information of the cartridge 1 and to open and apply a predetermined electric current to the state indicating element 2 through the control of the controller 30.

Figure 4:
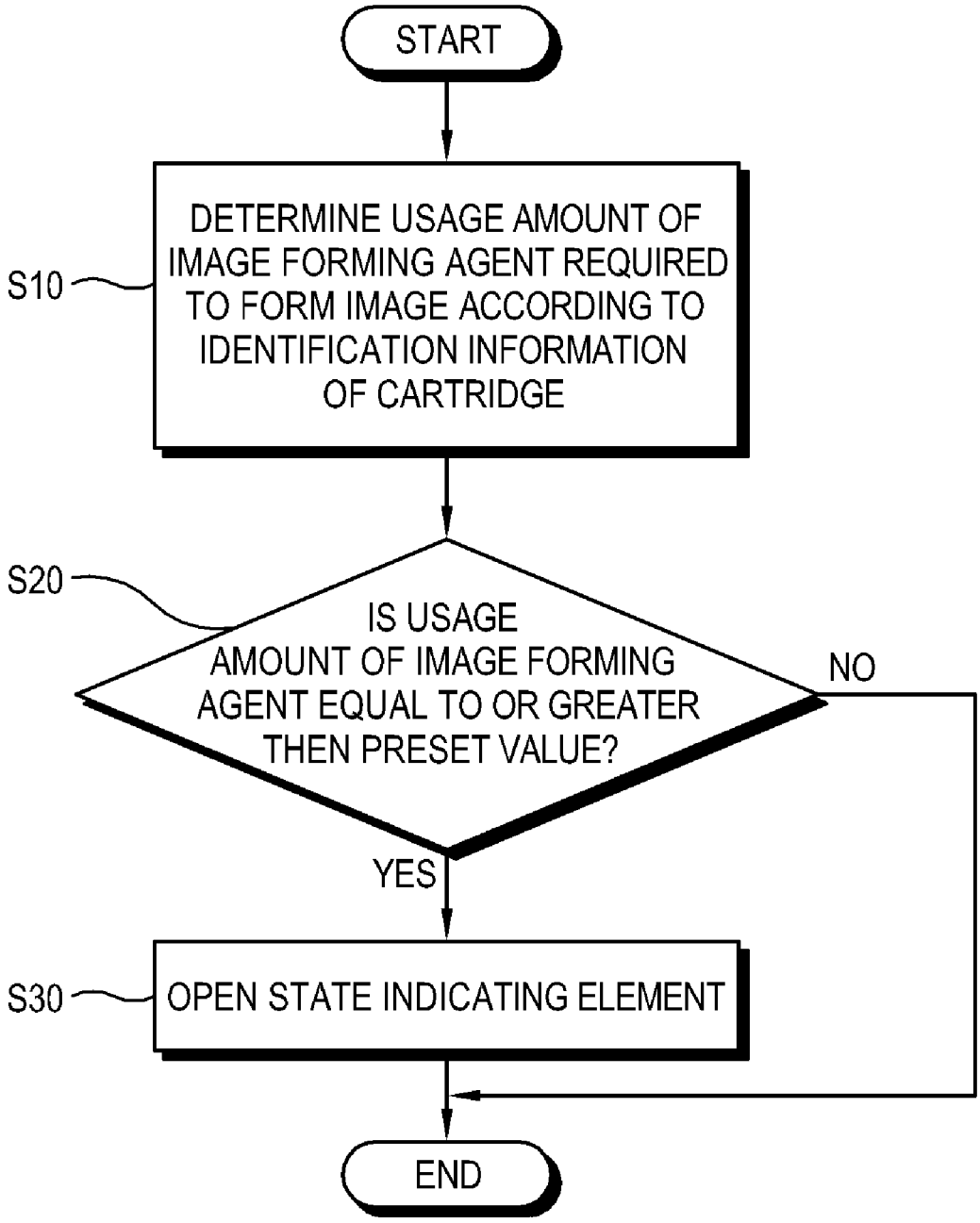
FIG. 4 is a flowchart to describe an image forming method according to an exemplary embodiment of the present general inventive concept.

Hereinafter, an image forming method according to an exemplary embodiment of the present general inventive concept will be described with reference to FIG. 4.

The controller 30 may determine the usage amount of the image forming agent of the cartridge 1 required to form an image (operation S10). At operation S10, the usage amount of the image forming agent may be determined by recognizing the identification information of the cartridge 1 or by counting a required number of dots to form the image.

The controller 30 determines whether the usage amount of the image forming agent is equal to a preset value or greater than the preset value (operation S20). If the usage amount of the image forming agent is equal to the preset value or greater, the controller 30 controls the state setting unit 20 to open the state indicating element 2 (operation S30). The operation S30 may further include an operation of providing information regarding the state of the state indicating element 2 through the image forming unit 40 to a display or to an external device, such as for example, a computer or server connected to the image forming unit 40.

Figure 5:
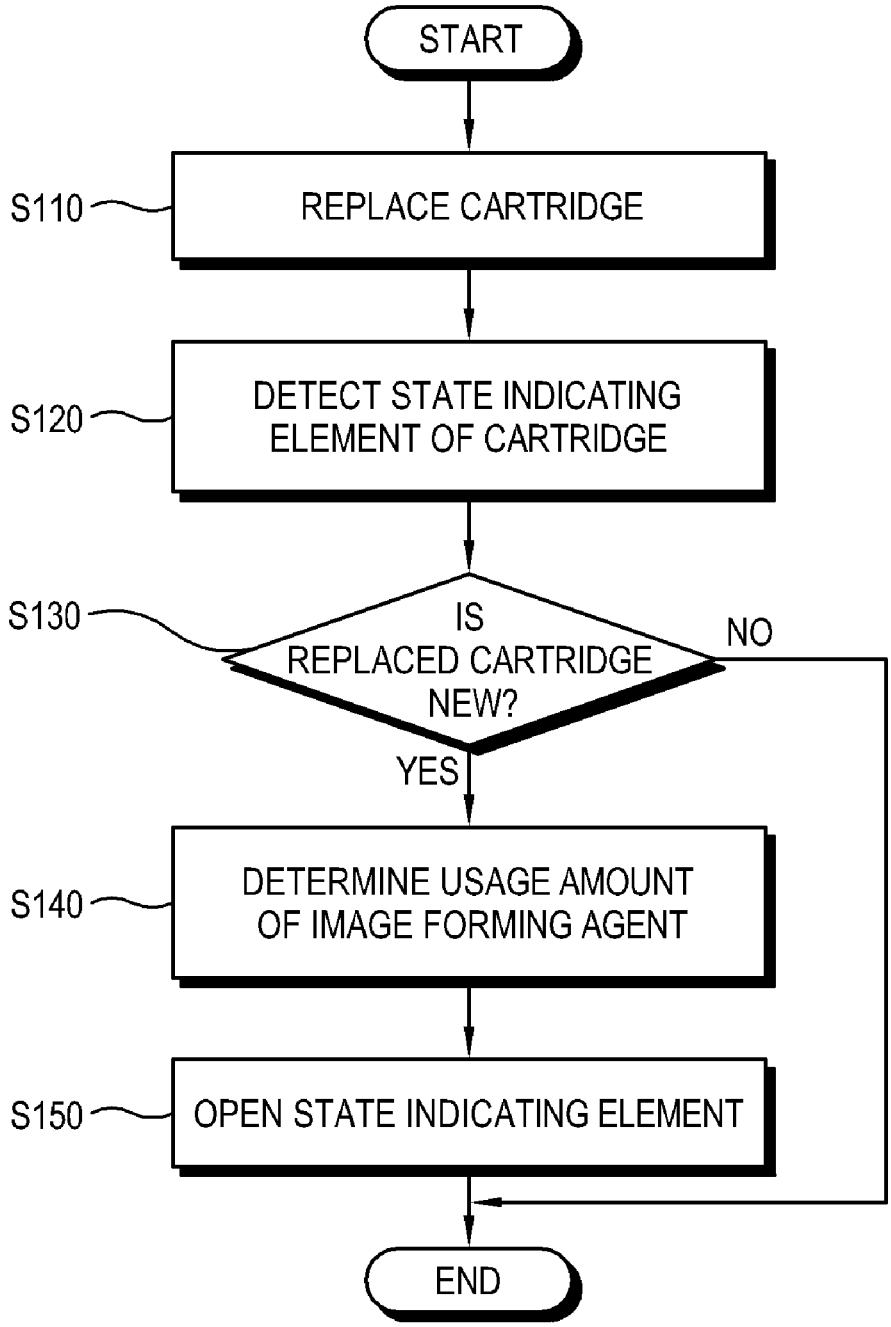
FIG. 5 is a flowchart to describe an image forming method according to another exemplary embodiment of the present general inventive concept.

FIG. 5 is a flowchart to describe an image forming method according to another exemplary embodiment of the present general inventive concept. Referring to FIG. 5, if the cartridge 1 of the image forming apparatuses 100 and 200 (referring to FIGS. 1 and 3) is replaced (operation S110), the controller 30 detects the state indicating element 2 of the cartridge 1 (operation S120). If it is determined that the cartridge 1 is a new one (operation S130), the controller 30 determines the usage amount of the image forming agent included in the new cartridge 1 (operation S140). As described above, the controller 30 may determine the usage amount of the image forming agent by counting the dots needed to form the image. The controller 30 controls the state setting unit 20 to open the state indicating element 2 included in the cartridge 1, based on the determined usage amount of the image forming agent (operation S150) and/or whether the cartridge 1 is genuine.

If the cartridge 1 is used and if the usage amount of the image forming agent is equal to the preset value or greater, the controller 30 may control the image forming unit 10 to not form the image.

The image forming apparatus, the cartridge and the image forming method according to embodiments of the present general inventive concept may encourage a user to use a genuine cartridge, and prevents an image from being deteriorated and the apparatus itself from being worn due to a non-genuine cartridge being used in the image forming apparatus.

Also, the image forming apparatus, the cartridge and the image forming method according to embodiments of the present general inventive concept may inform a user of the remaining usage amount of the cartridge or whether the cartridge is genuine.

Also, the image forming apparatus, the cartridge and the image forming method according to embodiments of the present general inventive concept may inform a user of the misinstallation of the cartridge if the cartridge is not correctly installed in the image forming apparatus, and instruct a user to correctly install the cartridge.

Further, the image forming apparatus, the cartridge and the image forming method according to embodiments of the present general inventive concept may also inform a user whether to reuse a cartridge.

The present general inventive concept can also be embodied as computer-readable codes on a computer-readable medium. The computer-readable medium can include a computer-readable recording medium and a computer-readable transmission medium. The computer-readable recording medium is any data storage device that can store data which can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

Although a few exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus, comprising:

an image forming unit to form an image and to receive an image forming agent from a cartridge having a state indicating element;

a state setting unit to open the state indicating element; and a controller to determine a usage amount of the image forming agent to be used to form the image by recognizing identification information of the cartridge, to have a limited image forming function if the identification information of the cartridge is not recognized by the controller, and to control the state setting unit to open the state indicating element of the cartridge if the determined usage amount of the image forming agent is substantially equal to or greater than a preset value.

2. The image forming apparatus according to claim 1, wherein the controller controls the image forming unit to not form the image if the identification information of the cartridge is not recognized by the controller.

3. The image forming apparatus according to claim 2, wherein the limited image forming function comprises:

at least one of a double side printing function, a high resolution function, a predetermined graphic mode, a predetermined printing concentration and a copying function.

4. The image forming apparatus according to claim 1, wherein the controller determines the usage amount of the image forming agent by counting dots needed to form the image.

5. The image forming apparatus according to claim 1, further comprising:

an informing unit, wherein the controller provides information regarding the state of the state indicating element through the image forming unit.

6. The image forming apparatus according to claim 1, wherein the controller controls the state setting unit to apply a predetermined electric current to open the state indicating element.

7. The image forming apparatus according to claim 6, wherein the state indicating element comprises a resistor which is fusible to receive the predetermined electric current.

8. A cartridge, comprising:

an accommodator to store an image forming agent therein to be supplied to an image forming apparatus to form an image; and a state indicating element to be opened by the image forming apparatus if a usage amount of the image forming agent required to form an image which is determined by identification information of the cartridge is substantially equal to or greater than a preset value, and wherein if the state indicating element is opened, only limited image forming function can be performed by the image agent.

9. The cartridge according to claim 8, wherein the state indicating element comprises a fusible resistor.

10. An image forming method, comprising:

recognizing identification information of a cartridge and determining a usage amount of an image forming agent required to form an image;

determining whether the usage amount of the image forming agent is substantially equal to or greater than a preset value; and opening a state indicating element included in the cartridge if the usage amount is substantially equal to or greater than the preset value, wherein only limited image forming functions can therefore be performed.

11. The image forming method according to claim 10, wherein the determining the usage amount of the image forming agent further comprises:

not performing an image forming operation if the identification information of the cartridge is not recognized.

12. The image forming method according to claim 11, wherein the limited image forming function comprises:

at least one of a double side printing function, a high resolution function, a predetermined graphic mode, a predetermined printing concentration and a copying function.

13. The image forming method according to claim 10, wherein the determining the usage amount of the image forming agent comprises:

determining the usage amount of the image forming agent by counting dots needed to form the image.

14. The image forming method according to claim 10, wherein the opening of the state indicating element further comprises:

providing information regarding the opening state of the state indicating element.

15. The image forming method according to claim 10, wherein the opening of the state indicating element comprises:

applying a predetermined electric current to the state indicating element.

16. The image forming method according to claim 10, wherein the state indicating element comprises a fusible resistor.

17. An image forming apparatus, comprising:

a replaceable printing cartridge having identification information and a selectable disable element; and a controller to form an image if the selectable disable element is not disabled and an amount of image forming agent stored within the cartridge is determined to be sufficient to form the image such that the sufficiency of the amount of the image forming agent is based on the identification information of the cartridge, wherein the controller is configured to determine whether to send an electrical signal to the selectable disable element based on the determination of the sufficiency of the amount of image forming agent, and further wherein the controller performs only a limited image forming function if the identification information of the replaceable printing cartridge is not recognized by the controller.

18. The image forming apparatus of claim 17, wherein the controller sends an electrical signal to the selectable disable element to disable the cartridge if the controller determines that there is insufficient image forming agent to form an image.

19. The image forming apparatus of claim 17, wherein the controller sends an electrical signal to the selectable disable element to disable the cartridge if the controller determines that the identification information is not that of a genuine replaceable printing cartridge.

20. A non-transitory computer readable recording medium having encoded thereon computer instructions that when executed by a computer perform a method to control an image forming apparatus, comprising:

recognizing identification information of a cartridge and determining a usage amount of an image forming agent required to form an image;

determining whether the usage amount of the image forming agent is substantially equal to or greater than a preset value; and opening a state indicating element included in the cartridge if the usage amount is substantially equal to or greater than the preset value, wherein only limited image forming functions can thereafter be performed.

* * * * *